US006499874B2

(12) United States Patent
Graemiger

(10) Patent No.: US 6,499,874 B2
(45) Date of Patent: Dec. 31, 2002

(54) TIMEPIECE WITH A MECHANISM FOR WINDING AND FOR CORRECTING AT LEAST TWO INDICATOR MEMBERS

(75) Inventor: Pierre-Alain Graemiger, Trelex (CH)

(73) Assignee: Rolex S.A., Geneva (CH)

( * ) Notice: Subject to any disclaimer, the term of this patent is extended or adjusted under 35 U.S.C. 154(b) by 54 days.

(21) Appl. No.: 09/849,034

(22) Filed: May 4, 2001

(65) Prior Publication Data

US 2001/0046187 A1 Nov. 29, 2001

(30) Foreign Application Priority Data

May 5, 2000 (EP) ..... 00810384

(51) Int. Cl.[7] ..... G04B 27/02; G04B 27/04
(52) U.S. Cl. ..... 368/190; 368/191; 368/195
(58) Field of Search ..... 368/36, 190–195, 368/319–321

(56) References Cited

U.S. PATENT DOCUMENTS 3,693,345 A * 9/1972 Schneider ..... 368/190
4,727,523 A * 2/1988 Morata ..... 368/191
5,392,260 A 2/1995 Wolfgang et al.

FOREIGN PATENT DOCUMENTS

CH 18 519/72 A4 10/1975
FR 2335881 7/1977

* cited by examiner

*Primary Examiner*—Vit Miska
(74) *Attorney, Agent, or Firm*—Henderson & Sturm LLP

(57) ABSTRACT

This timepiece has a winding stem (1) with three axial positions and two first connecting wheels (9, 10) which are superposed and pivoted about two respective stationary axes, and mesh with the winding pinion (2), two second connecting wheels (11, 14) meshing respectively with the said first connecting wheels (9, 10), two bars, namely a winding bar (8) and a connecting bar (15), which are pivoted coaxially to the respective axes of pivoting **(8*b*, 15*a*) of the said second connecting wheels (11, 14), one carrying a reverser pinion (12) and the other a correcting pinion (16), meshing with the said respective second connecting wheels (11, 14), means (7, 17, 15′*c*, 15′*d*) of connection between each of the two bars (8, 15) and the said pull-out piece (6) to act on the said bars (8, 15) according to the axial position of the said winding stem (1) so as selectively to place the said reverser pinion (12) in engagement with a winding ratchet wheel (13) and the said correcting pinion (16) in engagement with the said member (19, 20)** for indicating a function derived from time.

49 Claims, 5 Drawing Sheets

TIMEPIECE WITH A MECHANISM FOR WINDING AND FOR CORRECTING AT LEAST TWO INDICATOR MEMBERS

CROSS-REFERENCE TO RELATED APPLICATIONS

This application claims priority of EP Application No. 00810384.8 filed May 5, 2000.

STATEMENT REGARDING FEDERALLY SPONSORED RESEARCH OR DEVELOPMENT

Not Applicable.

BACKGROUND OF THE INVENTION:

1. Field of the Invention

The present invention relates to a timepiece with a mechanism for winding and for correcting at least two indicator members, comprising a winding stem, a pull-out piece engaged, on the one hand, with this winding stem and, on the other hand, with a jumper spring defining three axial positions of the said winding stem, corresponding to those for winding, for correcting at least one indicator member indicating a function derived from time, and for setting the correct time, the said winding stem carrying a winding pinion and a castle wheel engaged with a bar acted upon by a spring and connected to the said pull-out piece to selectively place the said castle wheel in engagement with the said winding pinion and with a minute-wheel geartrain when the said winding stem is in the extreme positions.

2. Description of the Prior Art

Such mechanisms are known and are used in all mechanism timepieces that comprise an indicator indicating a function derived from time, such as the days of the month, the days of the week, the phases of the moon, and the various time zones in particular.

Control of these various functions entails axial movement of the control rod, generally known as the winding stem, into three positions, the first position, that is to say the one in which the winding stem occupies the position in which it is pushed towards the centre of the movement is the usual winding position, one of the two remaining positions is the one for correcting the date or similar derived function, while the other of the remaining positions is the one for setting the correct time.

In general, the winding pinion pivoted on the winding stem is used only for winding when placed in engagement with the castle wheel and the latter is moved axially into the other two positions to come into engagement with a connecting wheel connected alternately to the geartrain for setting the correct time and to the geartrain for setting the date or any other derived function. When the timepiece indicates the days of the month and the days of the week, use is generally made of a bar which, in the correcting position, can move, depending on the direction in which the winding stem is turned, alternately between two angular positions so as to bring the correcting pinion into engagement with the day-of-the-month indicator or with the day-of-the-week indicator. Such correcting mechanisms are described, for example, in GB 1,234,004, in FR 2,169,861 or alternatively in CH 571,734.

One of the problems posed by operating three functions stems from the fact that the winding pinion is used only for winding, which means that the castle wheel has to control two functions. Now, the castle wheel with its two sets of teeth around the edge is the member which, by being moved axially over a portion of non-circular section of the stem makes it possible, in one axial position, to drive the winding pinion in one direction of rotation and, in the other axial position, to come into engagement with the minute-wheel geartrain in order to set the time. This member can thus fulfil two rather than three functions, which means that in three-function mechanisms, instead of coming directly into engagement with the minute-wheel geartrain, the castle wheel comes into engagement with a geartrain designed to be able to be connected alternately with the minute-wheel geartrain or with a geartrain for correcting the day-of-the-month indicator or indicator of some other function derived from time.

In order to switch from one correcting function to the other in these three-function mechanisms, it is therefore necessary to resort to somewhat complicated devices that employ systems involving connecting wheels, reverser pinions and multiple clutches, which may present problems of penetration of the sets of teeth in one another and therefore problems of wear and of bracing.

One of the problems encountered in such mechanisms is that of the winding stem becoming axially jammed when passing from one position to another, if the corrector malfunctions during the change in axial position, which jamming is brought about by the way in which the corrector is operated. Another problem is that of inadvertent correction brought about when the winding stem is moved from one axial position to another.

BRIEF SUMMARY OF THE INVENTION

The object of the present invention is to overcome the aforementioned drawbacks, at least in part.

To this end, a subject of the present invention is a timepiece with a mechanism for winding and for correcting at least two indicator members as defined in claim 1.

Unlike mechanisms of the prior art, the winding pinion controls two functions in succession: winding and correcting the indicator of a function derived from time, so that when the castle wheel is moved axially along the winding stem, it is in order to come into direct engagement with the minute-wheel geartrain. In consequence, the castle wheel of the mechanism for winding, for setting the time and for correcting some other indication derived from time, operates like a conventional castle wheel, remaining in engagement with the winding pinion in two of the three axial positions of the winding stem.

As to the winding pinion, instead of being in engagement with the edge teeth of the winding button, it is simultaneously in engagement with two fixed connecting wheels, themselves meshing with two respective second connecting wheels coaxial with two respective bars which, simply by moving these bars, allow the winding stem to be connected alternately with the winding ratchet wheel or with the corrector for correcting the indication derived from time. Finally, the castle wheel moves only upon the change to the position for setting the time, as in a bar and pull-out-piece conventional two-function winder.

Advantageously, in order to avoid the winding stem becoming jammed as it passes from the winding position to the position for correcting the indication derived from time, the castle wheel is moved into an intermediate axial position so that its teeth are not in engagement either with the winding pinion or with the minute-wheel geartrain.

This arrangement makes it possible to avoid the winding stem becoming jammed axially as it moves from the winding position to the position for correcting the indication derived from time. This operation causes the winding bar to move from the winding position into the position which disengages a reverser pinion carried by this bar and initially in engagement with the winder ratchet subjected, in one direction of rotation, to the tension of the mainspring and immobilized in the other direction of rotation by a retaining pawl. This arrangement also makes it possible, when the winding stem is moved in the opposite direction, to avoid inadvertently correcting the indicator that indicates a function derived from time.

BRIEF DESCRIPTION OF THE SEVERAL VIEWS OF THE DRAWINGS

Other specifics and advantages of this invention will become apparent with the aid of the following description, and with the aid of the appended drawing which, diagrammatically and by way of example, illustrates one embodiment and various alternative forms of the timepiece with a winding and correcting mechanism that is the subject of the present invention.

DETAILED DESCRIPTION OF THE INVENTION

Figure 1:
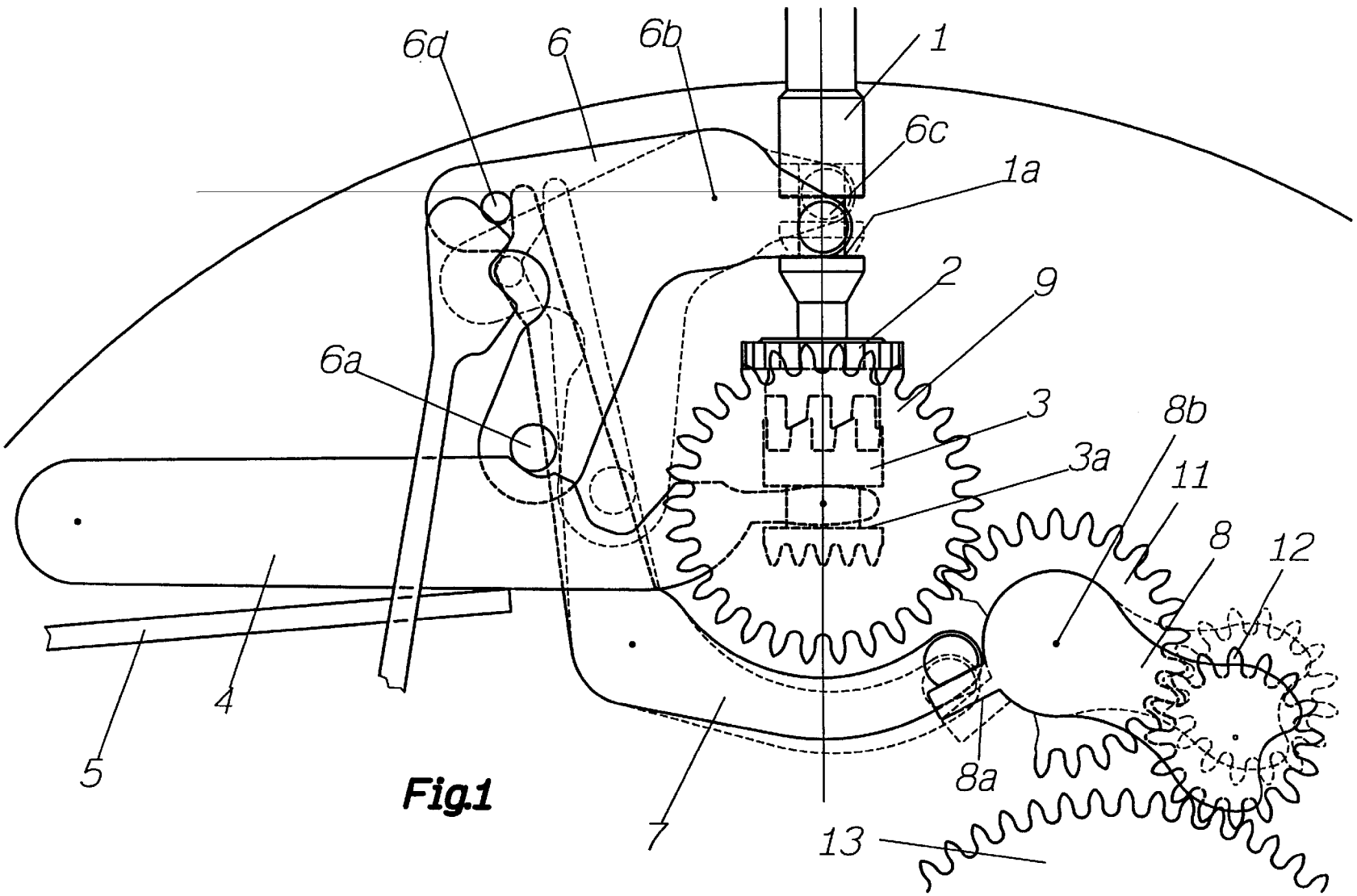
FIG. 1 is a plan view of this embodiment, showing the part of the timepiece on the movement side that exhibits the winding mechanism.
Figure 2:
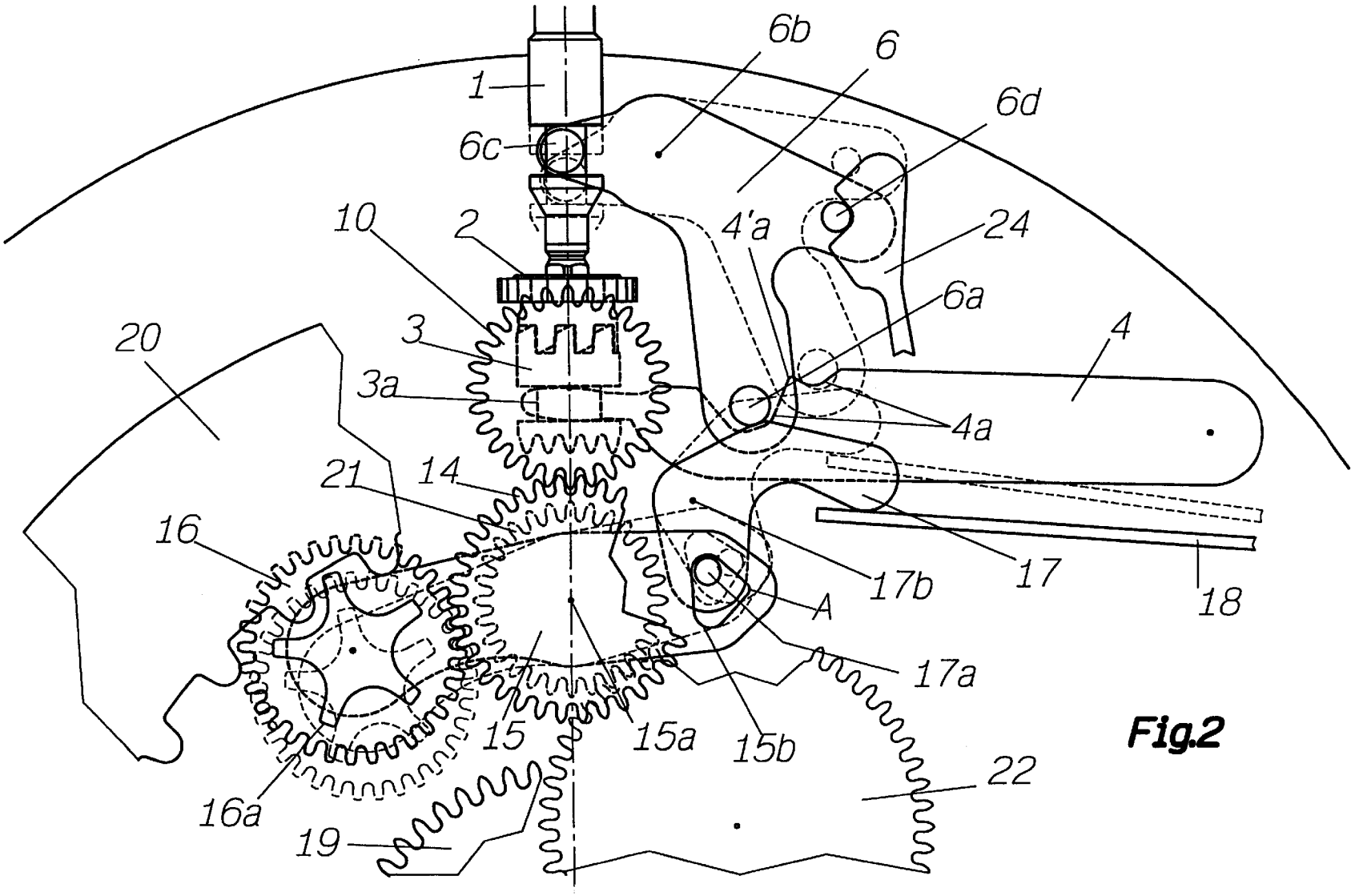
FIG. 2 is a plan view of this embodiment, showing the part of the timepiece on the dial side exhibiting the mechanism for correcting the indicators that indicate the day of the month and the day of the week.

The embodiment of the timepiece winding and correcting mechanism, illustrated in FIGS. 1 and 2 comprises a winding stem 1 capable of occupying three axial positions corresponding to three functions. This winding stem 1 carries a winding pinion 2 pivoting freely on the winding stem 1 and a castle wheel 3 which can move axially along a portion of square cross section of the winding stem 1, so that it rotates as one therewith.

The castle wheel 3 has a groove 3*a* in which a bar 4, acted upon by a spring 5, is engaged. The spring 5 applies this bar 4 against a pin 6*a* secured to a pull-out piece 6 pivoted about an axis 6*b* of a pull-out-piece screw and another pin 6*c* of which is engaged in a groove 1*a* of the winding stem 1. This pull-out piece 6 also comprises a third pin 6*d* in engagement, on the one hand, with a lever 7 for controlling a winding bar 8 and, on the other hand, with a jumper spring 24 (FIG. 2) that determines the various axial positions of the winding stem 1. The bar 8 has an arm 8*a* to allow the lever 7 to cause it to turn about its axis of pivoting 8*b* in the opposite direction to the hands of the timepiece, against the torque exerted on this bar 8 by a return spring (not depicted).

The winding pinion 2, which is a bevel pinion, meshes simultaneously with two connecting wheels 9, 10 (FIGS. 1 and 2), of which one, 9, is located on the same side of the winding stem 1 as the winding device, that is to say on the movement side, while the other, 10, is on the time-setting or dial side of the timepiece. These two connecting wheels 9, 10 are pivoted about stationary axes connected to the frame of the movement by support members that can be likened to bridges (not depicted).

The connecting wheel 9 meshes with a second stationary connecting wheel 11, pivoted about an axis 8*b* coaxial with that of the winding bar 8. This second connecting wheel 11 meshes with a winding reverser pinion 12 secured to the winding bar 8 and normally coming into engagement with a winding ratchet wheel 13 secured to the barrel arbor (not depicted) by virtue of the torque exerted by a return spring on the winding bar 8. In FIG. 1, the winding position is depicted in continuous line, while the positions for setting the date and setting the time are illustrated in chain line.

The connecting wheel 10 (FIG. 2) is in engagement with a second connecting wheel 14 pivoting about a stationary axis coaxial with the axis of pivoting 15*a* of a correcting bar 15. This connecting wheel 14 meshes with a correcting pinion 16 intended, in this embodiment, to correct the day of the month and the day of the week. To do this, aside from its teeth capable of coming into engagement with a wheel 19 secured to the day-of-the-week indicator, this correcting pinion 16 carries a star 16*a* intended to come into engagement with a ring 20 that indicates the day of the month.

Another connecting wheel 21, of smaller diameter than the connecting wheel 14, is pivoted coaxially to the latter and to the axis of pivoting of the correcting bar 15. This connecting wheel 21 meshes with a minute wheel 22 of the geartrain for setting the time.

The correcting bar 15 has a certain degree of freedom about its axis of pivoting 15*a,* this being limited by a triangular opening 15*b* in which a locking pin 17*a* of a locking lever 17 is engaged. This locking lever 17 is pressed against the pin 6*a* of the pull-out piece 6 by a spring 18 which exerts on it a torque which tends to cause it to turn in the opposite direction to the hands of the timepiece.

As can be seen in FIG. 2, the triangular opening 15*b* has one side which is more or less perpendicular to a straight line connecting the vertex A of this triangle opposite this side to the centre of pivoting 15*a* of the correcting bar 15. This arrangement means that when the locking pin 17*a* of the locking lever 17 is placed, by the pin 6*a* of the pull-out piece 6, at the vertex A of the triangular opening 15*b,* the bar 15 is immobilized in a position in which the correcting pinion 16 and its star 16*a* cannot come into engagement either with the ring 20 that indicates the days of the month or with the wheel 19 that indicates the days of the week. As can be seen, this locking of the correcting bar 15 in the inactive position corresponds to the two extreme axial positions of the winding stem 1, corresponding to the positions for winding and for setting correct time, respectively.

In the position illustrated in continuous line in FIG. 2 and which corresponds to the position for correcting the day of the month and the day of the week, the locking pin 17*a* of the locking lever 17 is positioned adjacent to the base opposite the vertex A of the triangular opening 15*b,* which means that the bar 15 is free to pivot about the axis of pivoting 15*a* in one direction or the other, within the limits set by the angle of travel between the two extreme positions of the triangular opening 15*b* with respect to the locking pin 17*a*.

One of these extreme positions, depicted in continuous line, corresponds to the star 16*a* of the correcting pinion 16 being placed in engagement with the day-of-the-month ring 20. The other of these extreme positions corresponds to the correcting pinion 16 meshing with the wheel 19 that indicates the day of the week. Movement from one position to the other is simply the result of the direction of rotation imparted to the connecting wheel 14 by the winding stem 1.

The bar 4 in engagement with the groove 3*a* of the castle wheel 3 has, like all bars of this type, a cam shape 4*a* collaborating with the pin 6*a* of the pull-out piece 6, to control the axial position of the castle wheel 3 along the winding stem 1, according to the axial position thereof. Unlike conventional bars of this type, the cam 4*a* has, in its part located in the path described by the pin 6*a* of the pull-out piece 6 between the winding and date-correcting positions, a raised portion 4'*a* which has the effect of causing an alternating axial movement of the castle wheel 3 upon passing from of these two positions to the other. The amplitude of this alternating movement of the castle wheel 3 is less than the travel that allows it to come into engagement with the connecting wheel 21 which means that when passing from the winding position to the date-correcting position, the winding stem 1 is completely disconnected from the various geartrains it is likely to actuate.

By virtue of this arrangement, when passing from the winding position to the position for correcting the date, the winding stem 1 cannot become jammed when the reverser pinion 12 disengages from the ratchet wheel 13 (FIG. 1), given that the winding pinion 2 is disengaged from this winding stem 1 during this operation. For the same reason, when passing from the date-correcting position to the winding position, there is no risk that a member indicating the date will be inadvertently moved.

As to the passage from the position for correcting the date to the one for setting the correct time, which corresponds to the axial position in which the winding stem 1 is in the extreme outermost position, given that it causes axial movement of the castle wheel 3 to bring it into engagement with the connecting wheel 21 of the minute-wheel geartrain, the winding pinion 2 controlling the other two functions is therefore disengaged from the winding stem 1 as early as the start of this operation. Thus, there is not likely to be any inadvertent movement or jamming.

As may be appreciated, the mechanism described maintains the essentials of the conventional two-position time-setting mechanism, the correction position corresponding to the third function of the winding stem being derived from the winding one, because it is also the winding pinion 2 which brings about this correction. The first connecting wheels 9, 10, the second connecting wheels 11, 14, the reverser pinion 12 and the correcting pinion 16 are driven both in the winding position and in the date-correcting position. In the winding position, the correcting bar 15 is locked in the inoperative position by the locking pin 17*a* of the locking lever 17, which means that the moving parts 10, 14 and 16 involved in correcting turn idly. In the position for correcting the date, it is the bar 8 which is disengaged and it is therefore the moving parts 9, 11, 12 involved in winding which turn idly.

Figure 3:
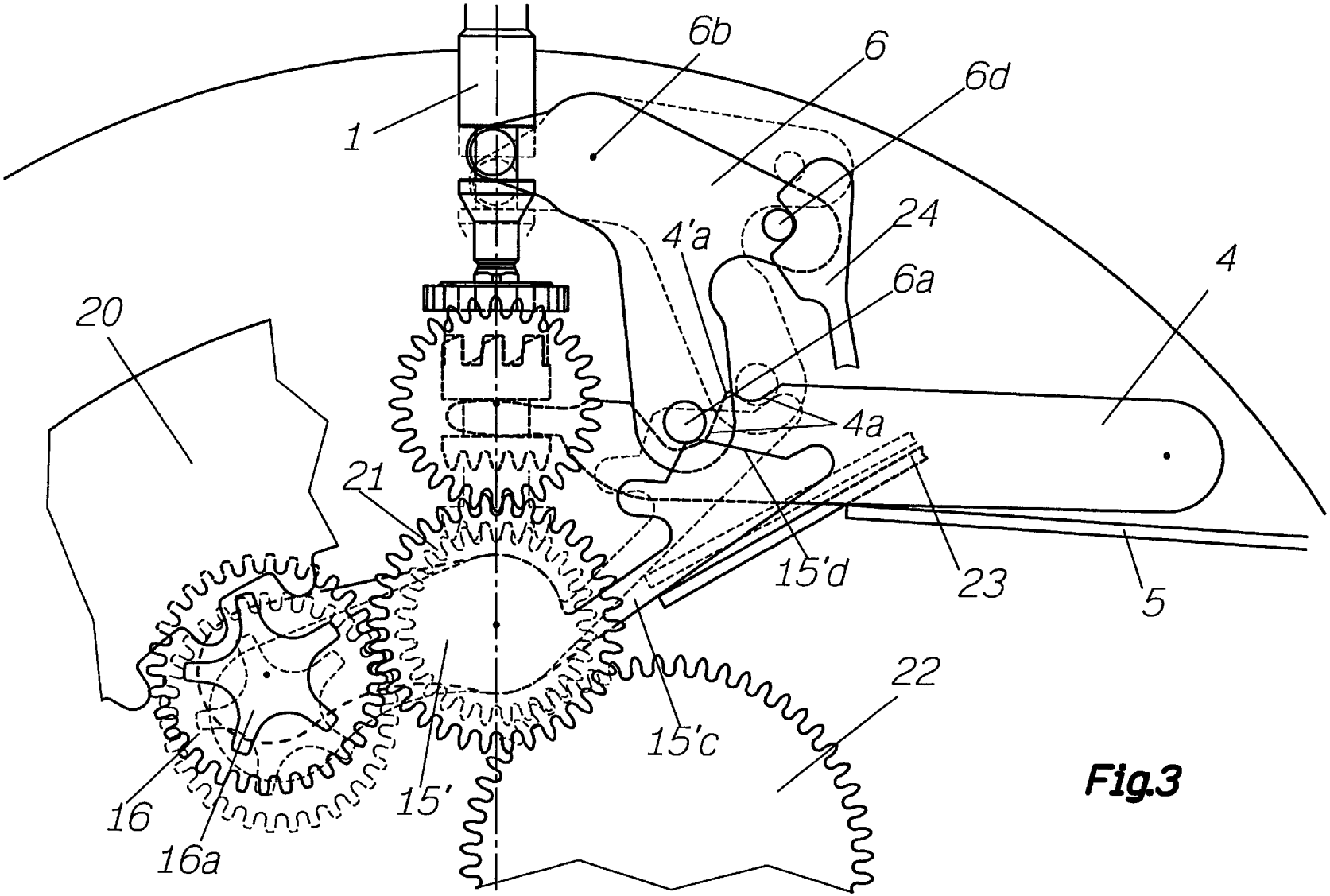
FIG. 3 is a plan view similar to FIG. 2, illustrating a first alternative form of the embodiment of FIGS. 1 and 2.

The embodiment described hereinabove relates to a timepiece that indicates the day of the month and the day of the week. The alternative form illustrated in FIG. 3 relates to a timepiece which indicates the day of the month only. That part of the mechanism relating to winding and illustrated in FIG. 1, and the one relating to the setting of the correct time remain unchanged. In the part of the mechanism that relates to correcting the day of the month, the locking lever 17 is omitted and the correcting bar 15' has an arm 15'*c* that carries a cam 15'*d* collaborating with the pin 6*a* of the pull-out piece 6. The cam 15'*d* of this correcting bar 15' is pressed against the pin 6*a* by a spring 23.

The difference between this correcting bar 15' and the one in the embodiment of FIG. 2 lies in the fact that the bar 15' is never free or locked, as the bar 15 is, but that it constantly follows the position defined by the cam 15'*d,* pressed against the pin 6*a* of the pull-out piece 6 by the return spring 23. As can be seen in this FIG. 3, the star 16*a* carried by the correcting pinion 16 is in engagement with the day-of-the-month ring 20 in the position illustrated in continuous line in FIG. 3, that is to say in the position for correcting the day of the month, while it is disengaged from the day-of-the-month ring 20 in the other two positions that correspond to the extreme positions of the winding stem 1.

Figure 4:
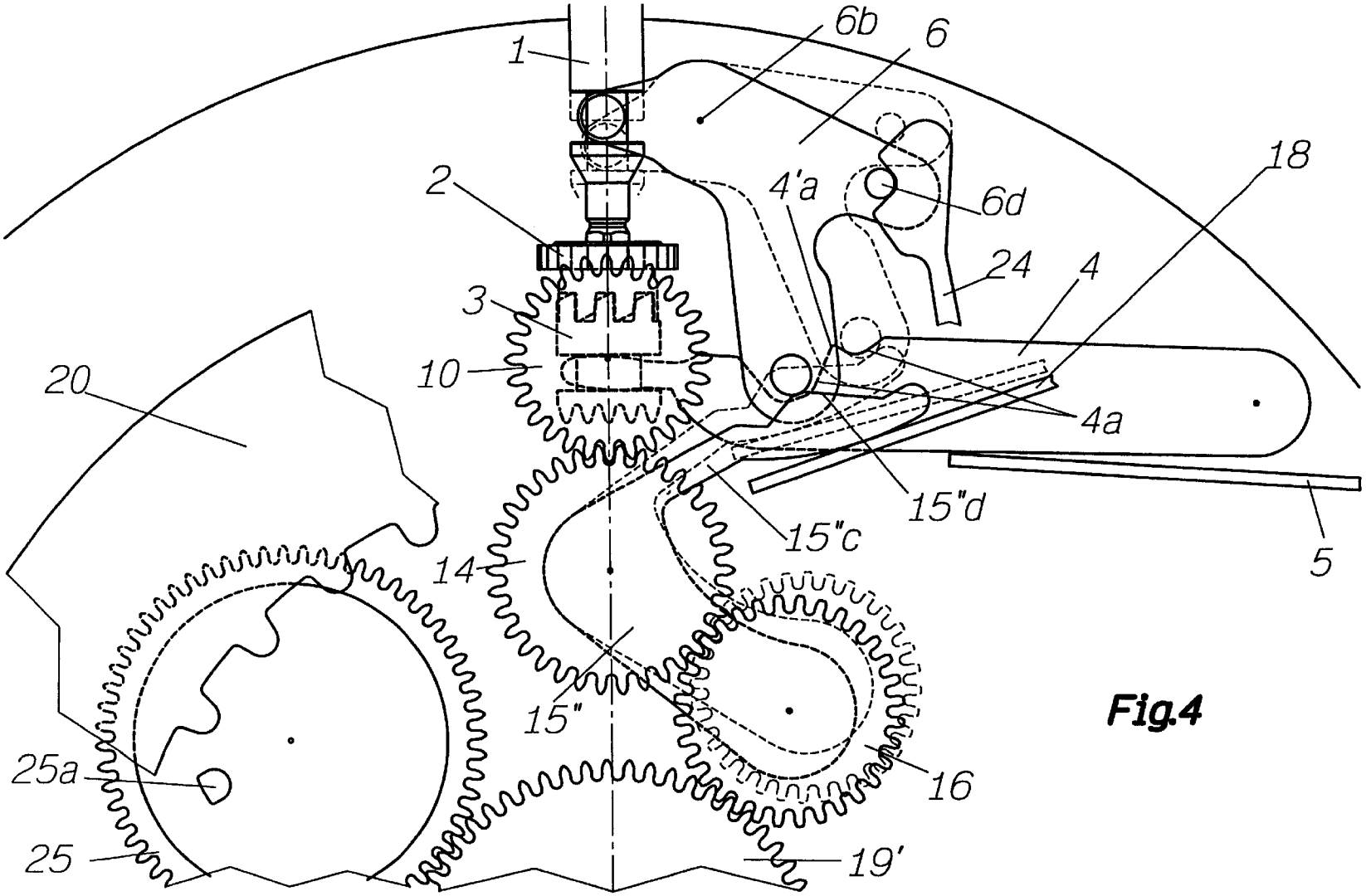
FIG. 4 is a plan view similar to FIG. 2 illustrating a second alternative form.

The alternative form illustrated in FIG. 4 differs from the previous one only in the form of the correcting bar 15", the correcting pinion 16 of which no longer carries a correcting star and can occupy, in the two respective positions defined by the correcting bar 15", two positions, one disengaged and the other engaged, with a central wheel 19' driving the indicator member (not depicted). This central indicator member constitutes a time-zone indicator of known type, moved jumpwise each hour by the central wheel 19'. This type of mechanism is known and does not form part of the invention, which means that it is not necessary for it to be described in order to understand the present invention.

The wheel 19' meshes with a wheel 25 carrying a finger 25*a* intended to drive the days-of-the-month ring 20 by one step for each revolution of the wheel 25, so that the days-of-the-month ring 20 is corrected via the central wheel 19' and the wheel 25.

Figure 5:
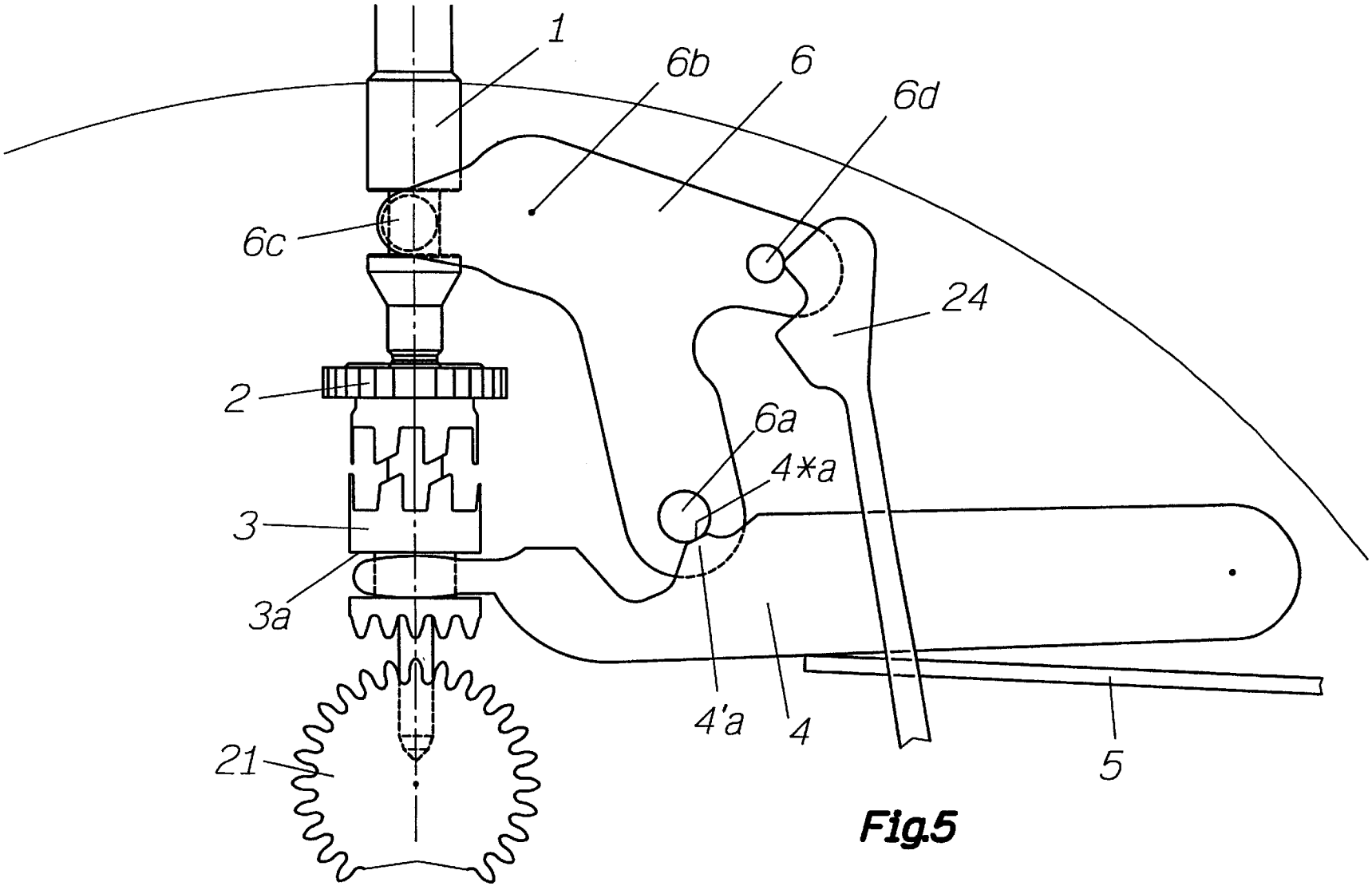
FIG. 5 is a plan view similar to FIG. 2 illustrating another alternative form showing only those elements of the mechanism which have been modified, this alternative form being applicable to the mechanisms of FIGS. 1 to 4.

The alternative form illustrated in FIG. 5 depicts a bar 4 in which the raised part 4'*a* of the cam 4*a* has a slight flat 4***a* intended to lengthen the period of disengagement between the castle wheel 3 and the winding pinion 2 as long as possible when passing from the winding position to the position for correcting the date or vice versa. Of course, the inclination given to the cam 4*a* for connecting the flat 4***a* has to be chosen so as to allow a smooth passage, without excessive force, from one position to the other in both directions of travel of the winding stem 1.

As may have been realized during the foregoing description, with the mechanism for winding and for correcting at least two indicators according to the present invention, each position of the winding stem 1 corresponds to a single function, the other functions being disabled simply by actuating the two bars 8 and 15, the castle wheel 3 not being disengaged from the winding pinion 2 except in the position for setting the time, like in a timepiece which indicates only the time in hours, minutes and seconds. With the exception of the winding reverser pinion 12 and the correcting pinion 16, all the other moving parts of the mechanisms have fixed axes of rotation. The number of disengagements and engagements is reduced to a minimum.

By virtue of the correcting bar 15, the date can be corrected at any time, without there being any risk of the winding stem becoming jammed or of causing damage to the mechanism.

The use of a bevel pinion as a winding pinion 2 allows the latter to mesh directly with the two pinions 9 and 10 of the winding geartrain and correcting geartrain, respectively, without the need for wheels with edge teeth.

What is claimed is:

1. Timepiece with a mechanism for winding and for correcting at least two indicator members, comprising a winding stem, a pull-out piece engaged, on the one hand, with this stem and, on the other hand, with a jumper spring defining three axial positions of the said winding stem, corresponding to those for winding, for correcting at least one indicator member indicating a function derived from time, and for setting the correct time, the said winding stem carrying a winding pinion and a castle wheel engaged with a bar acted upon by a spring and connected to the said pull-out piece to selectively place the said castle wheel in engagement with the said winding pinion and with a minute-wheel geartrain when the said winding stem is in the extreme positions, characterized in that the said mechanism comprises two first connecting wheels which are superposed and arranged one on each side of the said winding stem, pivoted about two respective stationary axes and meshing with the said winding pinion, two second connecting wheels pivoted about two respective stationary axes, meshing respectively with the said first connecting wheels, two bars, namely a winding bar and a correcting bar, which are pivoted coaxially to the respective axes of pivoting of the said second connecting wheels, one carrying a winding reverser pinion and the other a correcting pinion meshing with the said respective second connecting wheels, means of connection between each of the two bars and the said pull-out piece to act on the said bars according to the axial position of the said winding stem so as selectively to place the said winding reverser pinion in engagement with a winding ratchet wheel, in the said winding position, and the said correcting pinion in engagement with the said member for indicating a function derived from time, in the said correcting position.

2. Timepiece according to claim 1, characterized in that the said mechanism comprises means for bringing the said bar into engagement with the castle wheel in an intermediate position in which the castle wheel is disengaged both from the winding pinion and from the minute-wheel geartrain when the winding stem moves from the winding position to the position for correcting at least one member that indicates a function derived from time, and vice versa.

3. Timepiece according to claim 1, characterized in that the said means of connecting between that one of the said bars which carries the said correcting pinion for the said member that indicates a function derived from time and the said pull-out piece are means of locking and unlocking the said bar according to the axial position of the said winding stem.

4. Timepiece according to claim 1, characterized in that the said locking and unlocking means are shaped in such a way that in the said unlocked position, the said correcting bar is capable of moving from a position in which its correcting pinion is in engagement with a day-of-the-month indicator to a position in which it is in engagement with a day indicator, depending on the direction in which the said winding stem is turned.

5. Timepiece according to claim 1, characterized in that the said winding pinion has bevel teeth.

6. Timepiece according to claim 1, characterized in that the said indicator of a function derived from time is a time-zone indicator.

7. Timepiece according to claim 6, characterized in that means of kinematic connection connect the said time-zone indicator to a day-of-the-month indicator.

8. Timepiece according to claim 2, characterized in that the said pull-out piece has a common pin for operating the said means of connection between the said correcting bar and the said pull-out piece and the said bar in engagement with the castle wheel, the said means of bringing this bar into an intermediate position, in which the castle wheel is disengaged both from the winding pinion and from the minute-wheel geartrain, consisting of a cam integral with the said bar.

9. Timepiece according to claim 2, characterized in that the said means of connecting between that one of the said bars which carries the said correcting pinion for the said member that indicates a function derived from time and the said pull-out piece are means of locking and unlocking the said bar according to the axial position of the said winding stem.

10. Timepiece according to claim 2, characterized in that the said locking and unlocking means are shaped in such a way that in the said unlocked position, the said correcting bar is capable of moving from a position in which its correcting pinion is in engagement with a day-of-the-month indicator to a position in which it is in engagement with a day indicator, depending on the direction in which the said winding stem is turned.

11. Timepiece according to claim 3, characterized in that the said locking and unlocking means are shaped in such a way that in the said unlocked position, the said correcting bar is capable of moving from a position in which its correcting pinion is in engagement with a day-of-the-month indicator to a position in which it is in engagement with a day indicator, depending on the direction in which the said winding stem is turned.

12. Timepiece according to claim 9, characterized in that the said locking and unlocking means are shaped in such a way that in the said unlocked position, the said correcting bar is capable of moving from a position in which its correcting pinion is in engagement with a day-of-the-month indicator to a position in which it is in engagement with a day indicator, depending on the direction in which the said winding stem is turned.

13. Timepiece according to claim 2, characterized in that the said winding pinion has bevel teeth.

14. Timepiece according to claim 3, characterized in that the said winding pinion has bevel teeth.

15. Timepiece according to claim 9, characterized in that the said winding pinion has bevel teeth.

16. Timepiece according to claim 4, characterized in that the said winding pinion has bevel teeth.

17. Timepiece according to claim 10, characterized in that the said winding pinion has bevel teeth.

18. Timepiece according to claim 11, characterized in that the said winding pinion has bevel teeth.

19. Timepiece according to claim 12, characterized in that the said winding pinion has bevel teeth.

20. Timepiece according to claim 2, characterized in that the said indicator of a function derived from time is a time-zone indicator.

21. Timepiece according to claim 3, characterized in that the said indicator of a function derived from time is a time-zone indicator.

22. Timepiece according to claim 9, characterized in that the said indicator of a function derived from time is a time-zone indicator.

23. Timepiece according to claim 4, characterized in that the said indicator of a function derived from time is a time-zone indicator.

24. Timepiece according to claim 10, characterized in that the said indicator of a function derived from time is a time-zone indicator.

25. Timepiece according to claim 11, characterized in that the said indicator of a function derived from time is a time-zone indicator.

26. Timepiece according to claim 12, characterized in that the said indicator of a function derived from time is a time-zone indicator.

27. Timepiece according to claim 5, characterized in that the said indicator of a function derived from time is a time-zone indicator.

28. Timepiece according to claim 13, characterized in that the said indicator of a function derived from time is a time-zone indicator.

29. Timepiece according to claim 14, characterized in that the said indicator of a function derived from time is a time-zone indicator.

30. Timepiece according to claim 15, characterized in that the said indicator of a function derived from time is a time-zone indicator.

31. Timepiece according to claim 16, characterized in that the said indicator of a function derived from time is a time-zone indicator.

32. Timepiece according to claim 17, characterized in that the said indicator of a function derived from time is a time-zone indicator.

33. Timepiece according to claim 18, characterized in that the said indicator of a function derived from time is a time-zone indicator.

34. Timepiece according to claim 19, characterized in that the said indicator of a function derived from time is a time-zone indicator.

35. Timepiece according to claim 20, characterized in that means of kinematic connection connect the said time-zone indicator to a day-of-the-month indicator.

36. Timepiece according to claim 21, characterized in that means of kinematic connection connect the said time-zone indicator to a day-of-the-month indicator.

37. Timepiece according to claim 22, characterized in that means of kinematic connection connect the said time-zone indicator to a day-of-the-month indicator.

38. Timepiece according to claim 23, characterized in that means of kinematic connection connect the said time-zone indicator to a day-of-the-month indicator.

39. Timepiece according to claim 24, characterized in that means of kinematic connection connect the said time-zone indicator to a day-of-the-month indicator.

40. Timepiece according to claim 25, characterized in that means of kinematic connection connect the said time-zone indicator to a day-of-the-month indicator.

41. Timepiece according to claim 26, characterized in that means of kinematic connection connect the said time-zone indicator to a day-of-the-month indicator.

42. Timepiece according to claim 27, characterized in that means of kinematic connection connect the said time-zone indicator to a day-of-the-month indicator.

43. Timepiece according to claim 28, characterized in that means of kinematic connection connect the said time-zone indicator to a day-of-the-month indicator.

44. Timepiece according to claim 29, characterized in that means of kinematic connection connect the said time-zone indicator to a day-of-the-month indicator.

45. Timepiece according to claim 30, characterized in that means of kinematic connection connect the said time-zone indicator to a day-of-the-month indicator.

46. Timepiece according to claim 31, characterized in that means of kinematic connection connect the said time-zone indicator to a day-of-the-month indicator.

47. Timepiece according to claim 32, characterized in that means of kinematic connection connect the said time-zone indicator to a day-of-the-month indicator.

48. Timepiece according to claim 33, characterized in that means of kinematic connection connect the said time-zone indicator to a day-of-the-month indicator.

49. Timepiece according to claim 34, characterized in that means of kinematic connection connect the said time-zone indicator to a day-of-the-month indicator.

* * * * *